US012291315B2

(12) United States Patent
Räftegård

(10) Patent No.: US 12,291,315 B2
(45) Date of Patent: May 6, 2025

(54) CATHODIC PROTECTION AND ANTI-FOULING ARRANGEMENT AND METHOD

(71) Applicant: VOLVO PENTA CORPORATION, Gothenburg (SE)

(72) Inventor: Viktor Räftegård, Floda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 482 days.

(21) Appl. No.: 17/754,981

(22) PCT Filed: Oct. 18, 2019

(86) PCT No.: PCT/EP2019/078412
§ 371 (c)(1),
(2) Date: Apr. 18, 2022

(87) PCT Pub. No.: WO2021/073757
PCT Pub. Date: Apr. 22, 2021

(65) Prior Publication Data

US 2022/0363354 A1 Nov. 17, 2022

(51) Int. Cl.
*B63B 59/04* (2006.01)
*B63B 59/00* (2006.01)
(Continued)

(52) U.S. Cl.
CPC ..... *B63B 59/04* (2013.01); *B63H 20/32* (2013.01); *C23F 13/04* (2013.01); *C23F 13/06* (2013.01);
(Continued)

(58) Field of Classification Search
CPC ..... B63B 59/00; B63B 59/04; B63B 39/061; B63H 20/00; B63H 20/32; C23F 13/00;
(Continued)

(56) References Cited

U.S. PATENT DOCUMENTS 3,049,479 A * 8/1962 Preiser ..... C23F 13/06 204/196.36
4,486,181 A 12/1984 Cavil
(Continued)

FOREIGN PATENT DOCUMENTS

CN 103088345 A 5/2013
CN 103088345 B 12/2014
(Continued)

OTHER PUBLICATIONS

International Search Report and Written Opinion in corresponding International Application No. PCT/EP2019/078412 mailed Jul. 16, 2020 (8 pages).
(Continued)

*Primary Examiner* — Ajay Vasudeva
(74) *Attorney, Agent, or Firm* — Venable LLP; Jeffri A. Kaminski

(57) ABSTRACT

An anti-fouling arrangement in a marine vessel with a marine propulsion system, the propulsion system comprising at least one driveline housing, a torque transmitting drive shaft extending out of the driveline housing, and at least one propeller mounted on the drive shaft. The at least one propeller is electrically isolated from its drive shaft, wherein each electrically isolated propeller is connected to a positive terminal of a direct current power source, and each metallic component to be protected against fouling is connected to a negative terminal of the direct current power source. A control unit is arranged to regulate the voltage and current output from the direct current power source.

15 Claims, 4 Drawing Sheets

(51) Int. Cl.

| | |
|---|---|
| ***B63H 20/32*** | (2006.01) |
| ***C23F 13/04*** | (2006.01) |
| ***C23F 13/06*** | (2006.01) |
| *B63B 39/06* | (2006.01) |
| *B63H 20/00* | (2006.01) |

(52) U.S. Cl.
CPC ..... *B63B 39/061* (2013.01); *B63B 59/00* (2013.01); *B63H 20/00* (2013.01); *C23F 2213/31* (2013.01)

(58) Field of Classification Search
CPC ..... C23F 13/005; C23F 13/02; C23F 13/04; C23F 13/06; C23F 2213/31
See application file for complete search history.

(56) References Cited

U.S. PATENT DOCUMENTS

| | | | |
|---|---|---|---|
| 5,011,583 | A | 4/1991 | Tanbara |
| 5,298,794 | A | 3/1994 | Kuragaki |
| 7,131,877 | B1 | 11/2006 | Staerzl |
| 8,118,983 | B1 | 2/2012 | Anderson et al. |
| 2011/0089048 | A1 | 4/2011 | Nelvig et al. |
| 2016/0138173 | A1 | 5/2016 | Lambourne et al. |

FOREIGN PATENT DOCUMENTS

| | | | |
|---|---|---|---|
| CN | 106347602 | A | 1/2017 |
| CN | 108430868 | A | 8/2018 |
| GB | 1462931 | A | 1/1977 |
| GB | 2233981 | A | 1/1991 |
| JP | S58174094 | A | 10/1983 |
| JP | H02259089 | A | 10/1990 |
| NL | 9001663 | A | 2/1991 |
| RU | 2429158 | C1 | 9/2011 |
| SU | 918176 | A1 | 4/1982 |

OTHER PUBLICATIONS

Chinese Office Action dated May 16, 2023 in corresponding Chinese Patent Application No. 201980101359.9, 8 pages.

* cited by examiner

CATHODIC PROTECTION AND ANTI-FOULING ARRANGEMENT AND METHOD

CROSS-REFERENCE TO RELATED APPLICATIONS

This application is a U.S. National Stage application of PCT/EP2019/078412, filed Oct. 18, 2019 and published on Apr. 22, 2021, as WO 2021/073757, all of which is hereby incorporated by reference in its entirety.

TECHNICAL FIELD

The present invention relates to a cathodic protection and anti-fouling arrangement for protecting metal parts of a marine construction, such as a marine surface vessel or a marine structure, the arrangement comprising an anode and an optional reference electrode, wherein the metal parts, the anode and the reference electrode are adapted to be at least partly immersed in an electrolyte in the form of fresh or salt water in which the marine construction is at least partly immersed. The invention also relates to a marine vessel with such an arrangement, and also to a method for controlling such a system.

BACKGROUND

Marine fouling is a well-known problem for many marine applications. The build-up of marine organisms such as algae, mussels and barnacles on the exterior surfaces of the hulls and propulsion units of marine vessels will result in reduced performance, due to the increased resistance between the hull and water flowing past the hull. This will in turn result in increased fuel consumption. It is of particular interest to keep the propeller clean because of the increased drag effect from marine growth on propeller blades moving at high speed through the water. In severe cases, hull resistance and propeller drag might result in loss of maneuverability, which can become a safety concern. In addition, sea water is a corrosive environment for most metal parts used for marine propulsion units, which require cathodic protection not to corrode.

An efficient way of providing corrosion and marine growth protection is the use of a method termed impressed current cathodic protection (ICCP). ICCP systems are often used on cargo carrying ships, tankers and larger pleasure craft. US2011/089048A discloses the general principle for an ICCP system wherein a metal element and an anode are attached to a vessel and immersed in water. The metal element is connected to the positive terminal and the sacrificial anode is connected to the negative terminal of a source DC electrical power to provide an electric de-passivation current through an electrical circuit including the sacrificial anode, the metal element and the electrolyte. In this way, the anode provides corrosion protection for the metal part.

A problem with a standard ICCP system is that they can be quite bulky. For larger vessels this is less of a problem, as the increase in drag caused by externally mounted ICCP units is small in relation to the drag of a relatively large hull. For relatively small vessels, however, the problem of added drag and/or limit available space on or near the transom can become an issue. For vessels used as pleasure craft, externally mounted ICCP units can also cause aesthetic issues.

A further problem is that many types of relatively smaller vessels equipped with, for instance, stern drives or outboard engines can have very limited physical space available on the transom or the hull where ICCP units could be fitted. Vessels of this type are usually provided with less efficient passive sacrificial anode protection.

The invention provides an improved anti-fouling method and arrangement aiming to solve the above-mentioned problems.

SUMMARY

An object of the invention is to provide a cathodic protection and anti-fouling method and arrangement for a marine propulsion system, which solves the above-mentioned problems.

The object is achieved by a cathodic protection and anti-fouling arrangement and a method according to the appended claims.

In the subsequent text, the cathodic protection and anti-fouling arrangement according to the invention is described for application to a marine propulsion system in the form of a stern drive mounted to a transom on the vessel. However, the inventive arrangement is also applicable to, for instance, azimuthing or pod drives and outboard drives. The cathodic protection and anti-fouling arrangement according to the invention involves an impressed current cathodic protection (ICCP) arrangement which is operated using direct current (DC). In the subsequent text, the power source used for supplying DC power to the arrangement is not necessarily a battery, but can be any suitable source of electrical power such as a fuel cell or a source of alternating current (AC) provided with an AC/DC rectifier.

According to a first aspect of the invention, a marine vessel with a marine propulsion system is provided with a cathodic protection and anti-fouling arrangement. The marine propulsion system comprises at least one driveline housing at least partially submerged in water, a torque transmitting drive shaft extending out of each driveline housing and at least one propeller mounted on the drive shaft. According to the invention, the at least one propeller is electrically isolated from its drive shaft and each electrically isolated propeller is connected to a positive terminal of a direct current power source. The vessel can comprise one or more driveline housings comprising a single drive shaft with a propeller, or counter-rotating propellers with coaxial drive shafts. The anti-fouling arrangement can use at least one or preferably all propellers making up the propulsion system. Simultaneously, the arrangement provides cathodic protection, wherein each metallic component to be protected against corrosion is connected to a negative terminal of the direct current power source. A control unit is arranged to regulate the voltage and current output from the direct current power source.

The cathodic protection and anti-fouling arrangement is an impressed current cathodic protection (ICCP) arrangement and at least one propeller is used as an anode. The at least one metallic component to be protected forms a cathode and can be the at least one driveline housing, at least one trim tab, seawater intake, swimming platform and/or at least a portion of the vessel hull. Note that this is a non-exclusive list of metallic components suitable for marine growth and corrosion protection. At the same time, the ICCP arrangement provides marine growth protection for the at least one anode.

According to one example, the at least one propeller is electrically isolated from its drive shaft by a torque transmitting electrically isolating component mounted between the at least one propeller and its respective drive shaft. The electrically isolating component is mounted in a gap formed by the outer surface of the drive shaft and the inner surface of the propeller hub. The torque transmitting electrically isolating component can be made from an elastic material, such as a natural or synthetic rubber. The at least one propeller is made from an inert anode material, such as titanium, niobium or a similar suitable metal or metal alloy.

According to a further example, a dielectric shield can be provided between the at least one propeller and the drive shaft on which the propeller is mounted. A dielectric shield is used as an electrical insulator that can be polarized by an applied electric field. When a dielectric material is placed in an electric field, electric charges do not flow through the material as they do in an electrical conductor but only slightly shift from their average equilibrium positions causing dielectric polarization. Because of dielectric polarization, positive charges are displaced in the direction of the field and negative charges shift in the opposite direction. This creates an internal electric field that reduces the overall field within the dielectric itself. In this arrangement the dielectric shield is used to protect the surface of the drive shaft near the propeller hub from hydrogen embrittlement and local overprotection caused by unacceptably high potentials in areas adjacent the at least one propeller that is used as an anode. Local overprotection can cause adjacent surfaces of the drive shaft to become too negatively polarized, wherein a dielectric shield is provided to prevent high current densities on those surfaces.

The dielectric shield can comprise a layer of dielectric material extending along the drive shaft over at least the entire axial extension of the propeller hub. A dielectric material is a substance that is a poor conductor of electricity, but an efficient supporter of electrostatic fields. A non-exclusive list of suitable materials for use in such a dielectric shield includes polymer or polymer-ceramic materials with suitable dielectric properties.

According to a further example, the propeller can be connected to the positive terminal of the direct current power source by wiring extending through a hollow portion of the drive shaft. For instance, an axially extending internal groove can be provided in the inner surface of the drive shaft and can be used for the electrical wiring. Alternatively an external groove in the outer surface of the drive shaft can be used for the electrical wiring to the at least one propeller. The electrical wiring can be electrically connected to the hub of the propeller by means of a wiping contact within the hub portion surrounding the drive shaft or a wiping contact located inside the transmission housing.

According to a further example, the cathodic protection and anti-fouling arrangement comprises a reference electrode that is at least partially submerged in water and is connected to the control unit in order to provide a ground reference value. The ground reference value is used to determine the effectiveness of the anti-fouling arrangement. In response to this determination, the control unit can regulate or fine tune the voltage and current output from the direct current power source.

According to a second aspect of the invention, the invention relates to a marine vessel that is protected by a cathodic protection and anti-fouling arrangement as described above. The cathodic protection and anti-fouling arrangement can be operated using an on-board source of DC power or using DC power supplied from a shore facility, in order to conserve the on-board power source.

According to a third aspect of the invention, the invention relates to a method for protecting a marine vessel with a marine propulsion system against corrosion and fouling. The propulsion system comprises at least one driveline housing at least partially submerged in water; a torque transmitting drive shaft extending out of the driveline housing; and at least one propeller mounted on the drive shaft. The method involves performing the steps of:

providing a direct current power source;

causing at least one metallic component of the vessel to act as a cathode, and causing the at least one propeller of said marine propulsion system to act as an anode in a galvanic circuit which comprises at least one metallic component, at least one propeller and water, in which water the metallic component and the propeller are at least partially submerged, and electrically connecting said anode to the direct current power source and directing a direct current flow through said galvanic circuit.

According to a further example, the method involves controlling the direct current flow through said galvanic circuit using a reference electrode at least partially submerged in water to provide a ground reference value for the control unit.

The arrangement according to the invention solves at least in part the problem of added drag caused by externally mounted ICCP units. By using an existing component, in this case a propeller, as the anode of an ICCP system, added drag from an externally mounted anode is avoided. Using a propeller as the anode also avoids any aesthetic issues caused by extra components mounted on the hull or transom. The invention also solves the problem of limited physical space available on the transom or the hull for vessels with stern drives or outboard, as the anode can be replaced by the at least one propeller. The arrangement provides protection against fouling for the propellers and simultaneous corrosion protection for metallic components connected to the arrangement. Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
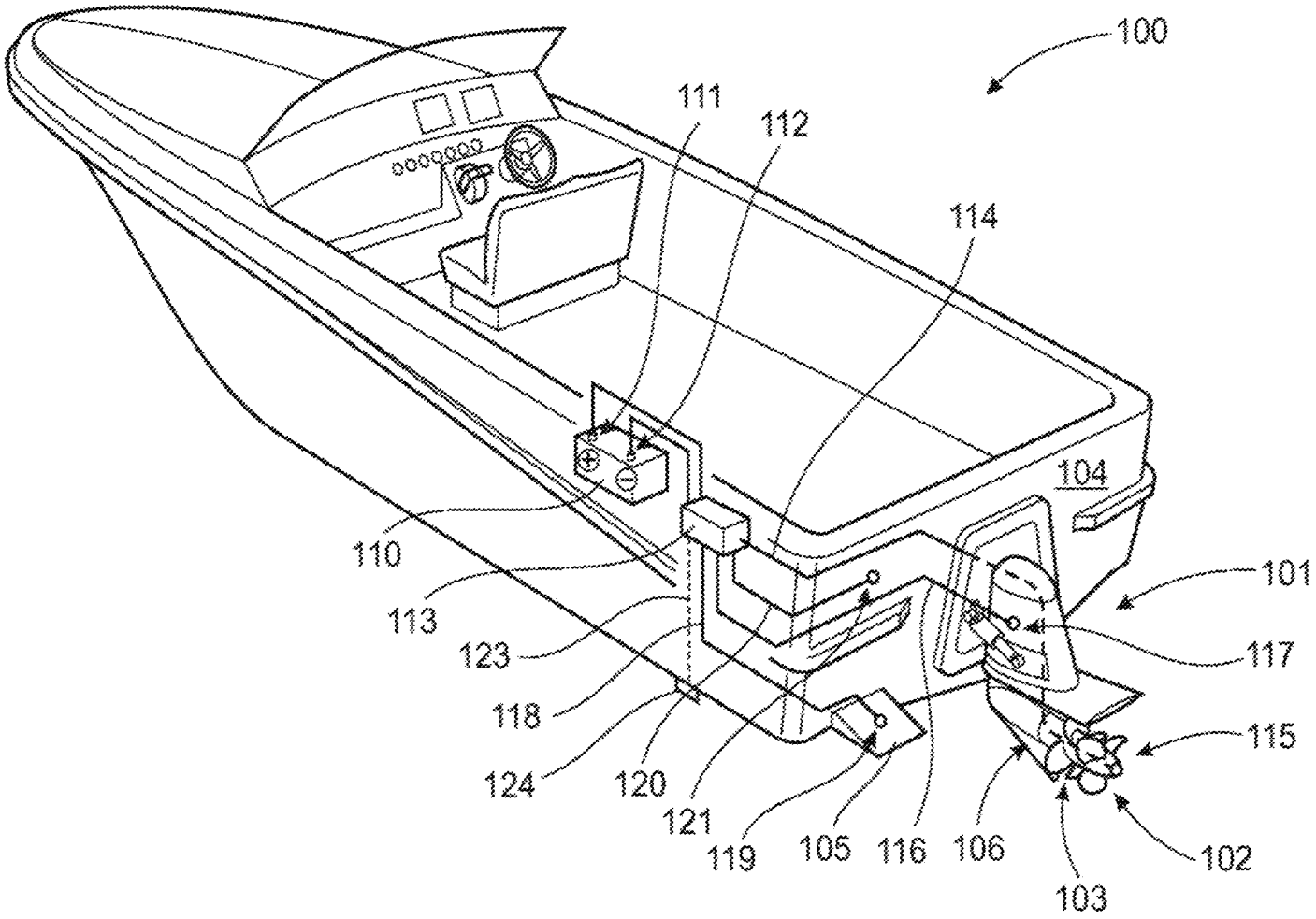
FIG. 1 shows a schematically illustrated vessel comprising a marine anti-fouling arrangement/corrosion protection system according to the invention.
Figure 2:
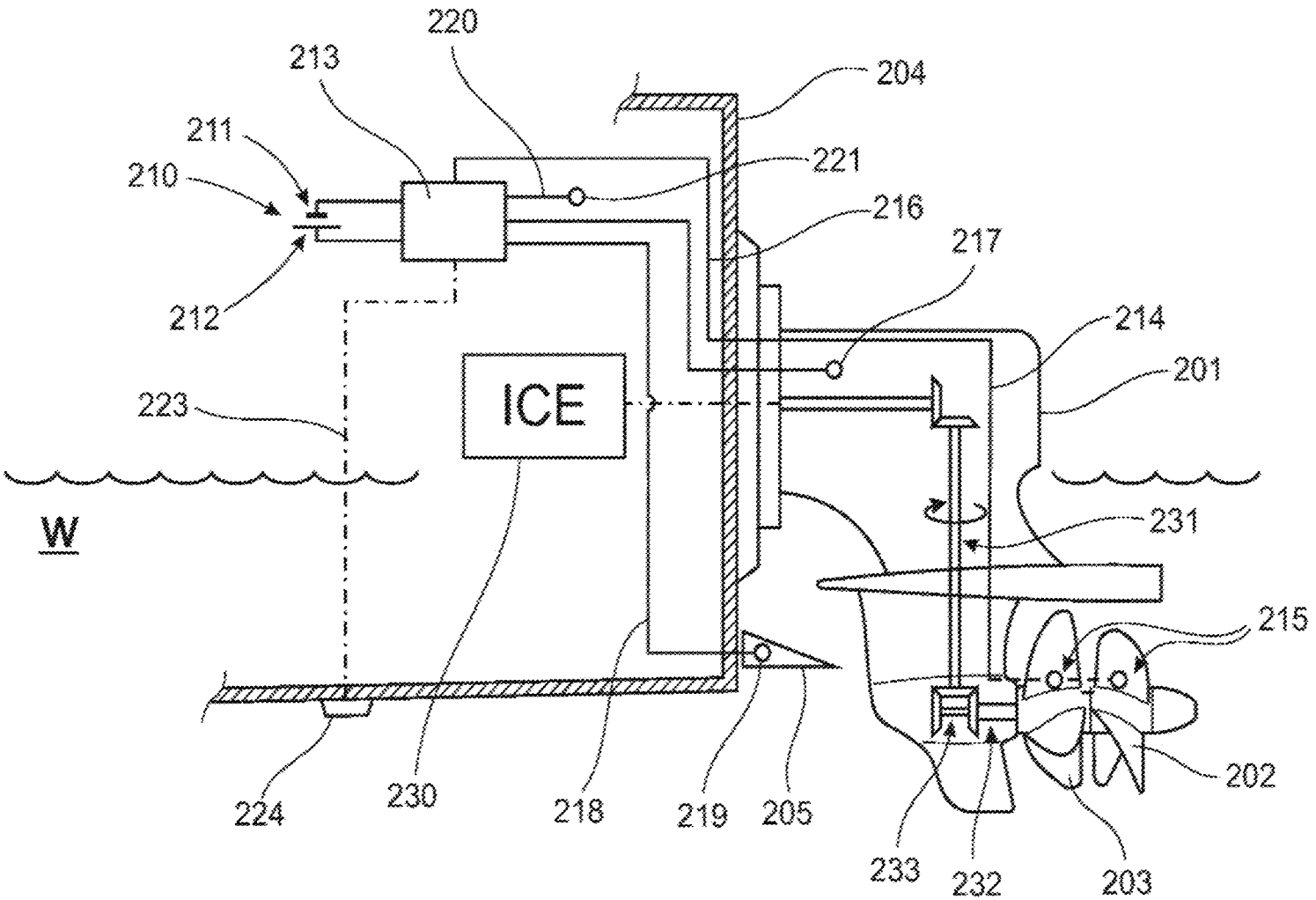
FIG. 2 shows a schematic a cross-section of the rear portion of the marine vessel.

FIG. 1 shows a schematically illustrated marine vessel 100 comprising an anti-fouling arrangement according to the invention. The vessel comprises a hull with a transom 104 to which a marine propulsion system is attached. The propulsion system in this example comprises a single driveline housing 101 at least partially submerged in water, a torque transmitting drive shaft 106 (not shown) extending out of the driveline housing 101, and a pair of counter-rotating propellers 102, 103 mounted on the drive shaft 106. In the current example, both propellers 102, 103 are electrically isolated from its drive shaft 106. The drive shaft arrangement is shown in FIG. 2 and will be described in further detail below. Each electrically isolated propeller 102, 103 to be protected against fouling is connected to a positive terminal 111 of a direct current (DC) power source 110, such as a battery, in order to form an anode. Further, each metallic component 101, 104, 10 to be protected against corrosion is connected to a negative terminal 112 of the direct current power source 110, in order to form cathodes. A control unit 113 is connected to the direct current power source 1 and distributes current to all component parts forming an electrical circuit. The control unit 113 is arranged to regulate the voltage and current output from the direct current power source 110. In order to assist regulation of the voltage and current output a reference electrode 124 is mounted on the hull remote from the anode and connected to the control unit 113 via an electrical wire 123. The reference electrode 124 measures a voltage difference between itself and the metallic components, which is directly related to the amount of protection received by the anode. The control unit 113 compares the voltage difference produced by the reference electrode 124 with a pre-set internal voltage. The output is then automatically adjusted to maintain the electrode voltage equal to the pre-set voltage.

Regulation of the voltage and current output from the direct current power source is controlled to automate the current output while the voltage output is varied. This allows the protection level to be maintained under changing conditions, e.g. variations in water resistivity or water velocity. In a sacrificial anode system, increases in the seawater resistivity can cause a decrease in the anode output and a decrease in the amount of protection provided, while a change from stagnant conditions results in an increase in current demand to maintain the required protection level. With ICCP systems protection does not decrease in the range of standard seawater nor does it change due to moderate variations in current demand. An advantage of ICCP systems is that they can provide constant monitoring of the electrical potential at the water/hull interface and can adjust the output to the anodes in relation to this. An ICCP system comprising a reference electrode is more effective and reliable than sacrificial anode systems where the level of protection is unknown and uncontrollable.

The anti-fouling arrangement is an impressed current cathodic protection (ICCP) arrangement using the propellers 102, 103 as an anode 115. In FIG. 1, the metallic component to be protected against corrosion is the driveline housing 101, the trim tabs 105 (one shown), and a metal portion of the hull, in this case the transom 104. Note that this is a non-exclusive list of metallic components suitable for marine growth and corrosion protection. In order to achieve this, the positive terminal 111 and the negative terminal 112 of the battery 1 are connected to the control unit 113. The control unit 113 is arranged to connect the positive terminal 111 to the propellers 102, 103 via a first electrical wire 114. The control unit 113 is further arranged to connect the negative terminal 112 to an electrical connector 117 on the driveline housing 101 via a second electrical wire 116. The negative terminal 112 is also connected to an electrical connector 119 on the trim tab 10 via a third electrical wire 118, and connected to an electrical 3 connector 121 on the transom 104 via a fourth electrical wire 120.

FIG. 2 shows a cross-section of the rear portion of the marine vessel 100 of FIG. 1, through a transom 204 and a driveline housing 201. The single driveline housing 201 is partially submerged in water and comprises torque transmitting drive shafts 232, 233 extending out of the driveline housing 201. A pair of counter-rotating propellers 202, 203 is mounted on their respective drive shafts 233, 232. In this example, the drive shafts 232, 233 are driven by an internal combustion engine ICE via a transmission 231. Transmissions for driving counter-rotating propellers are well known in the art and will not be described in detail here. Alternative drive units for driving the propellers are possible within the scope of the invention. Both propellers 202, 203 are electrically isolated from its respective drive shaft 232, 233 (see FIGS. 3A-B). As schematically indicated in FIG. 2, each electrically isolated propeller 202, 203 is connected to a positive terminal 211 of a direct current power source 2 at schematically indicated points 2 via electrical wiring 214. The electrical connection of the propellers will be described in further detail below. Further, each metallic component 201, 204, 20 to be protected against fouling is connected to a negative terminal 212 of the direct current power source 210. A control unit 213 is arranged to regulate the voltage and current output from the direct current power source 210. As described above, the positive terminal 211 and the negative terminal 212 of the battery 2 are connected to the control unit 213. The control unit 213 is arranged to connect the positive terminal 211 to the propellers 202, 203 via a first electrical wire 214. The control unit 213 is further arranged to connect the negative terminal 212 to an electrical connector 217 on the driveline housing 201 via a second electrical wire 216. The negative terminal 212 is also connected to an electrical connector 219 on the trim tab 205 (one shown) via a third electrical wire 218, and connected to an electrical connector 221 on the transom 204 via a fourth electrical wire 220. A reference electrode 224 is mounted on the hull remote from the propellers 202, 203 forming an anode and connected to the control unit 213 via an electrical wire 223. Regulation of the voltage and current output from the direct current power source using the control unit 213 has been described above.

Figure 3B:
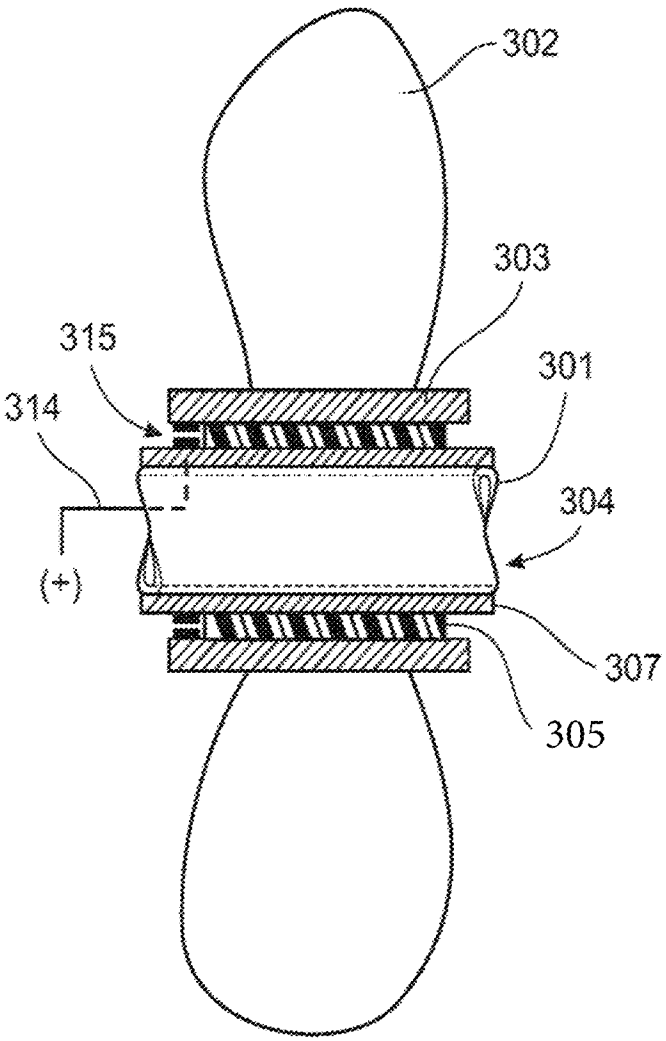
FIG. 3A-B show schematic cross-sections through a pair of propellers.
Figure 3A:
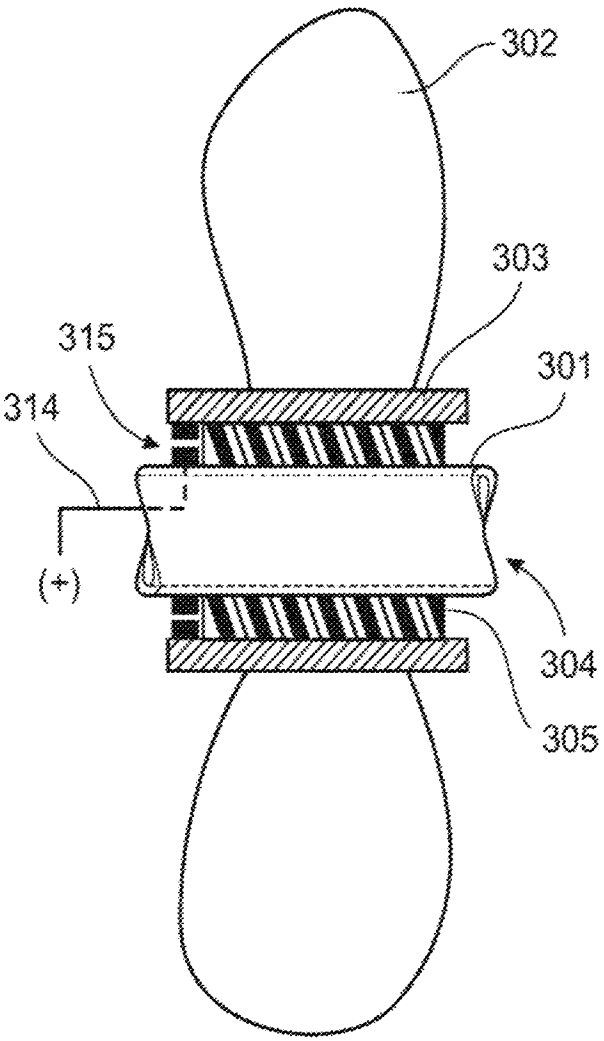

FIGS. 3A and 3B show schematic cross-sections of propeller arrangements suitable for use with the invention. FIG. 3A shows a schematic propeller 302 that is electrically isolated from its drive shaft 301 by a torque transmitting electrically isolating component 305 mounted between the propeller 302 and the drive shaft 301. The electrically isolating component is mounted in a gap formed by the outer surface of the drive shaft 301 and the inner surface of the propeller hub 303. The torque transmitting electrically isolating component 30 can be made from an elastic material, such as a natural or synthetic rubber. The propeller 302 is connected to the positive terminal of the direct current power source (see FIG. 2) by electrical wiring 314 extending through a hollow portion 304 of the drive shaft 301. For instance, an axially extending internal groove can be provided in the inner surface of the drive shaft can be used for the electrical wiring. Alternatively an external groove in the outer surface of the drive shaft can be used for the electrical wiring to the propeller. The location of the wiring is dependent on factors such as whether a single propeller or a counter-rotating duo-prop arrangement is used. The electrical wiring 314 is electrically connected to the hub 303 of the propeller by means of a wiping contact 3 mounted between the drive shaft 301 and the hub 303. A wiping contact mounted inside the transmission housing and an electrical wire in or along the drive shaft can be used for connecting the positive terminal of a power source to the propeller hub.

FIG. 3B shows a schematic propeller 302 that is electrically isolated from its drive shaft 301 by a torque transmitting electrically isolating component 30 mounted between the propeller 302 and the drive shaft 301. As in FIG. 3A, the electrically isolating component is mounted in a gap formed by the outer surface of the drive shaft 301 and the inner surface of the propeller hub 303. The torque transmitting electrically isolating component 30 can be made from an elastic material, such as a natural or synthetic rubber. The propeller 302 is connected to the positive terminal of the direct current power source (see FIG. 2) by electrical wiring 314 extending through a hollow portion 304 of the drive shaft 301. For instance, an axially extending internal groove can be provided in the inner surface of the drive shaft can be used for the electrical wiring. Alternatively an external groove in the outer surface of the drive shaft can be used for the electrical wiring to the propeller. The location of the wiring is dependent on factors such as whether a single propeller or a counter-rotating duo-prop arrangement is used. The electrical wiring 314 is electrically connected to the hub 303 of the propeller by means of a wiping contact 315 mounted between the drive shaft 301 and the hub 303. Alternative solutions can include a wiping contact mounted inside the transmission housing and an electrical wire in or along the drive shaft for direct connection to the propeller hub.

The example in FIG. 3B differs from that of FIG. 3A in that a dielectric shield 307 is provided between the propeller 302 and the drive shaft 301 on which the propeller is mounted. The dielectric shield 307 is used as an electrical insulator that can be polarized by an applied electric field. When a dielectric material is placed in an electric field, electric charges do not flow through the material as they do in an electrical conductor but only slightly shift from their average equilibrium positions causing dielectric polarization. Because of dielectric polarization, positive charges are displaced in the direction of the field and negative charges shift in the opposite direction. This creates an internal electric field that reduces the overall field within the dielectric itself. In this arrangement the dielectric shield 307 is used to protect the surface of the drive shaft 301 near the propeller hub 303 from hydrogen embrittlement caused by unacceptably high potentials in areas adjacent the propeller 302 that is used as an anode in the anti-fouling arrangement.

The dielectric shield 307 can comprise a layer of dielectric material extending along the drive shaft over at least the entire axial extension of the propeller hub 303. The dielectric shield 307 is preferably arranged to extend a predetermined length $L_1$ and $L_2$ in front of and behind the propeller hub 303, respectively, in order to ensure that the protection potential at the point of contact with the shaft does not become to electronegative. The lengths $L_1$ and $L_2$ will vary depending on anode area, propeller hub design and the protection current used for the actual application. A dielectric material is a substance that is a poor conductor of electricity, but an efficient supporter of electrostatic fields. A non-exclusive list of suitable materials for use in such a dielectric shield includes polymer or polymer-ceramic materials with suitable dielectric properties.

Figure 4:
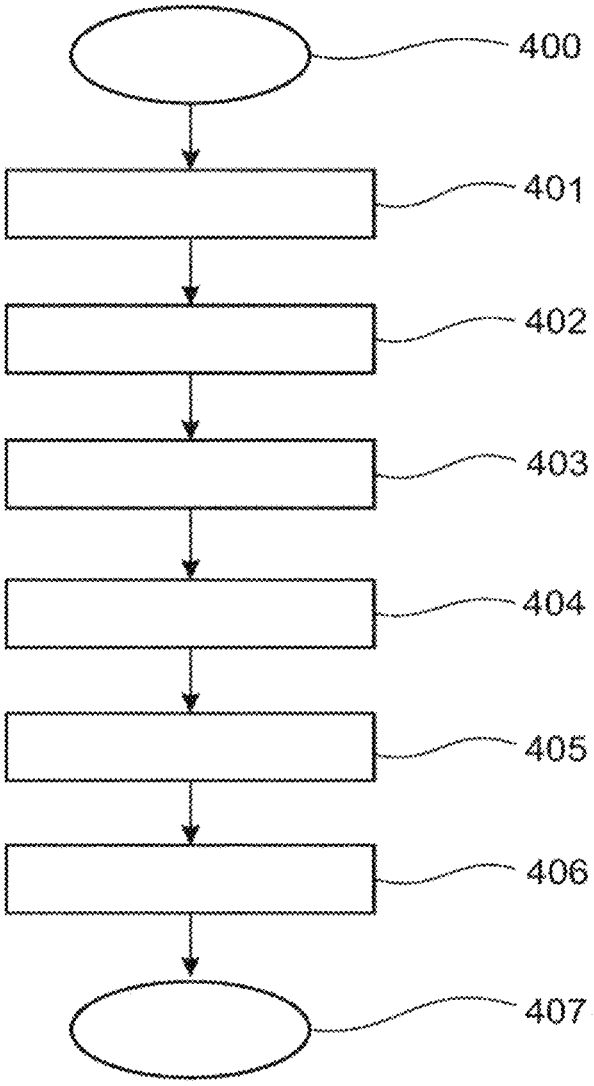
FIG. 4 shows a schematic diagram illustrating the operation of an anti-fouling arrangement according to the invention.

FIG. 4 shows a schematic diagram illustrating a method of operating a cathodic protection and anti-fouling arrangement according to the invention. In operation, the method comprises an initial step 400 when the arrangement is being operated for protecting a marine vessel with a marine propulsion system against corrosion of submerged metallic components and fouling of the propellers. The cathodic protection and anti-fouling arrangement can be operated using an on-board source of DC power, as described in connection with FIGS. 1 and 2, or using DC power supplied from a shore facility, in order to conserve the on-board power source.

As described above, the propulsion system comprises at least one driveline housing at least partially submerged in water; a torque transmitting drive shaft extending out of the driveline housing; and at least one propeller mounted on the drive shaft. In a first step 401, the method involves providing electrical power from a direct current (DC) power source. In a second step 402, the method involves causing at least one metallic component of the vessel to act as a cathode, by connecting the at least one metallic component to a negative terminal of the DC power source. In a third step 403, the method involves causing the at least one propeller of said marine propulsion system to act as an anode, by connecting the at least one propeller to a positive terminal of the DC power source. The arrangement forms a galvanic circuit which comprises the DC power source, the at least one metallic component, the at least one propeller and water, in which water the metallic component and the propeller are at least partially submerged. In a fourth step 404, the method involves electrically connecting said anode to the DC power source and directing a direct current flow through said galvanic circuit. In a fifth step 405, the method involves controlling the direct current flow through said galvanic circuit by means of a control unit. In a sixth step 406, which can be optional, the method involves connecting the control unit to a reference electrode which at least partially submerged in water. The reference electrode provides a ground reference value for the control unit. After a predetermined period of operation, the anti-fouling arrangement can be disconnected from the power source in a final step 407. The cathodic protection and anti-fouling arrangement can be operated continuously or at least over extended periods of time, as long as shore power is provided. When an on-board source of power is used, the anti-fouling arrangement can be operated intermittently or over limited periods of time, while the power levels of the on-board power source allows.

It is to be understood that the present invention is not limited to the embodiments described above and illustrated in the drawings; rather, the skilled person will recognize that many changes and modifications may be made within the scope of the appended claims.

The invention claimed is:

1. A marine vessel comprising a cathodic protection and anti-fouling arrangement and a marine propulsion system, the marine propulsion system comprising;

at least one driveline housing at least partially submerged in water;

a torque transmitting drive shaft extending out of the driveline housing;

at least one propeller mounted on the drive shaft;

the arrangement being wherein the at least one propeller is electrically isolated from the drive shaft the at least one propeller is mounted on;

the at least one electrically isolated propeller to be protected against fouling is connected to a positive terminal of a direct current power source;

at least one metallic component of the marine vessel to be protected against corrosion is connected to a negative terminal of the direct current power source; and that a control unit is arranged to regulate the voltage and current output from the direct current power source.

2. Marine vessel according to claim 1, wherein the arrangement is an impressed current cathodic protection arrangement and that the at least one propeller is an anode.

3. Marine vessel according to claim 1, wherein the at least one propeller is made from an inert metallic anode material.

4. Marine vessel according to claim 1, wherein the metallic component to be protected is the at least one driveline housing.

5. Marine vessel according to claim 1, wherein the metallic component to be protected is at least one trim tab.

6. Marine vessel according to claim 1, wherein the metallic component to be protected is a metal portion of the vessel hull.

7. Marine vessel according to claim 1, wherein a torque transmitting electrically isolating component is mounted between the at least one propeller and the drive shaft.

8. Marine vessel according to claim 7, wherein the torque transmitting electrically isolating component is made from an elastic material.

9. Marine vessel according to claim 8, wherein the elastic material is a natural or synthetic rubber.

10. Marine vessel according to claim 1, wherein a reference electrode is at least partially submerged in water and is connected to the control unit in order to provide a ground reference value.

11. Marine vessel according to claim 1, wherein a dielectric shield is provided between the at least one propeller and the drive shaft.

12. Marine vessel according to claim 11, wherein the dielectric shield comprises a layer of dielectric material extending along the drive shaft over at least the entire axial extension of the propeller hub.

13. Marine vessel according to claim 1, wherein the propeller is connected to the positive terminal of the direct current power source by wiring extending through a hollow portion of the drive shaft.

14. A method for protecting a marine vessel with a marine propulsion system against corrosion and fouling, the propulsion system comprising;

at least one driveline housing at least partially submerged in water;

a torque transmitting drive shaft extending out of the driveline housing;

at least one propeller mounted on the drive shaft;

the method comprising:

providing electrical power from a direct current power source;

causing at least one metallic component of the vessel to act as a cathode, and causing the at least one propeller of said marine propulsion system to act as an anode in a galvanic circuit which comprises the at least one metallic component, the at least one propeller and water, in which water the metallic component and the propeller are at least partially submerged, and electrically connecting said anode to the direct current power source and directing a direct current flow through said galvanic circuit.

15. A method according to claim 14, further comprising controlling the direct current flow through said galvanic circuit using a reference electrode at least partially submerged in water to provide a ground reference value for the control unit.

* * * * *